United States Patent [19]

Wheelwright

[11] 4,078,465

[45] Mar. 14, 1978

[54] PROGRAMMABLE MEMORY SYSTEM FOR ELECTRONIC MUSICAL INSTRUMENT

[75] Inventor: Robert W. Wheelwright, Amherst, N.Y.

[73] Assignee: The Wurlitzer Company, Chicago, Ill.

[21] Appl. No.: 730,785

[22] Filed: Oct. 8, 1976

[51] Int. Cl.[2] ..... G10B 3/10; G10H 1/00

[52] U.S. Cl. ..... 84/1.01; 84/1.03; 84/345; 84/370

[58] Field of Search ..... 84/1.01, 1.03, 345, 84/370

[56] References Cited

U.S. PATENT DOCUMENTS

| | | | |
|---|---|---|---|
| 3,659,488 | 5/1972 | Deutsch | 84/345 |
| 3,699,839 | 10/1972 | Denigan et al. | 84/345 |
| 3,700,784 | 10/1972 | Molnar | 84/345 |
| 3,926,088 | 12/1975 | Davis et al. | 84/1.01 X |
| 4,006,658 | 2/1977 | Kappes et al. | 84/345 |

*Primary Examiner*—Stanley J. Witkowski

*Attorney, Agent, or Firm*—Olson, Trexler, Wolters, Bushnell & Fosse, Ltd.

[57] ABSTRACT

A non-volatile programmable memory storage system for use with electronic musical instruments is provided which utilizes an erasable and reprogrammable read only memory (EPROM). The EPROM is provided with suitable erasure means, either electrical or ultraviolet light. Also provided is means for entering and retrieving data from the EPROM and means for bidirectionally transferring data between the EPROM and the electronic musical instrument.

15 Claims, 5 Drawing Figures

FIG. 2

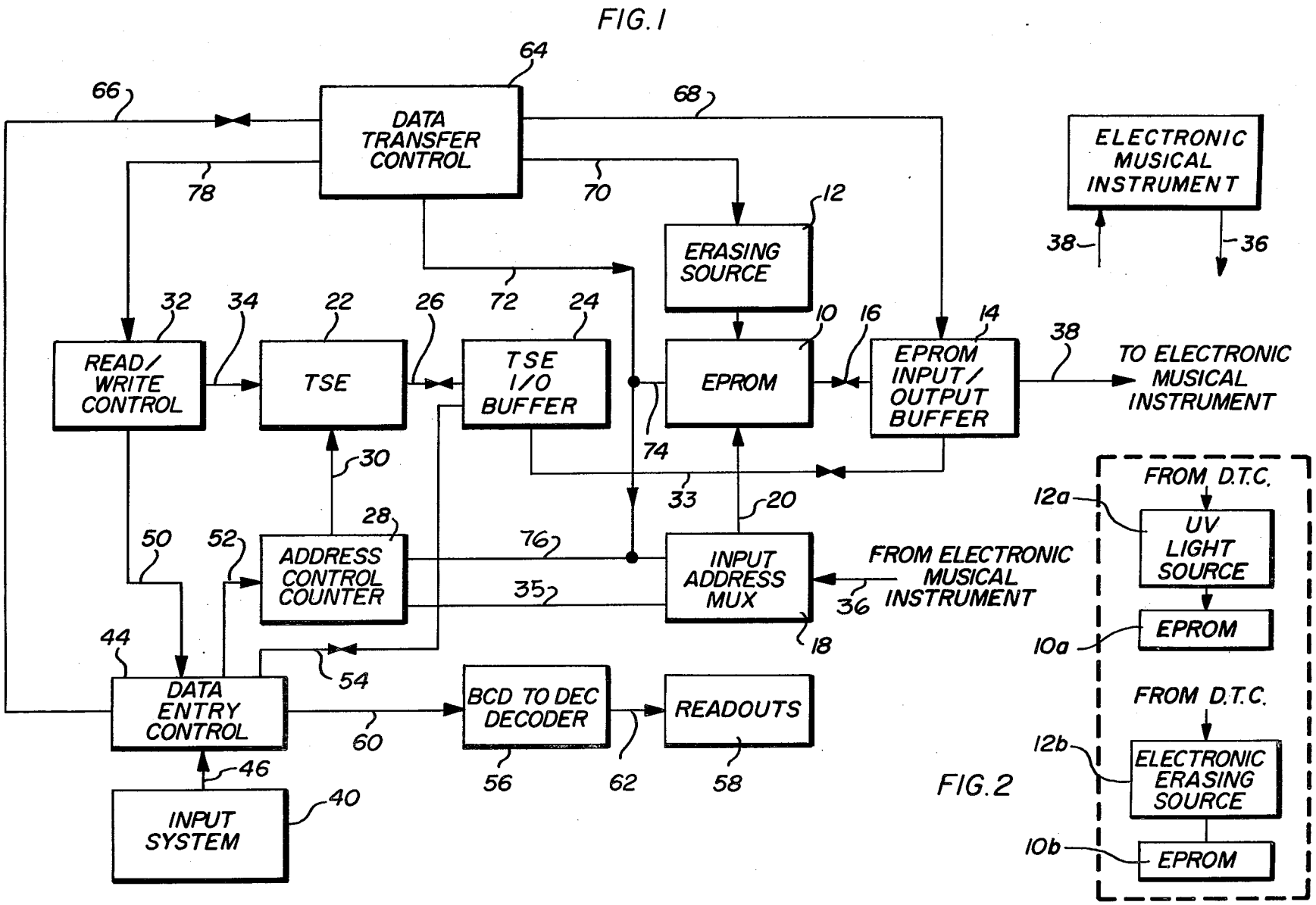
ELECTRONIC MUSICAL INSTRUMENT
36
38
TO ELECTRONIC MUSICAL INSTRUMENT
38
FROM D.T.C.
UV LIGHT SOURCE
EPROM
FROM D.T.C.
ELECTRONIC ERASING SOURCE
EPROM
12a
10a
12b
10b
FIG. 2
EPROM INPUT/ OUTPUT BUFFER
14
16
FROM ELECTRONIC MUSICAL INSTRUMENT
36
18
12
ERASING SOURCE
10
EPROM
20
INPUT ADDRESS MUX
READOUTS
58
68
33
74
62
70
24
TSE I/O BUFFER
76
35
BCD TO DEC DECODER
56
64
DATA TRANSFER CONTROL
72
26
TSE
22
30
28
ADDRESS CONTROL COUNTER
54
60
40
34
52
46
INPUT SYSTEM
78
32
READ/ WRITE CONTROL
50
DATA ENTRY CONTROL
44
66
FIG. 1

PROGRAMMABLE MEMORY SYSTEM FOR ELECTRONIC MUSICAL INSTRUMENT

BACKGROUND OF THE INVENTION

The present invention is directed to the use of a non-volatile programmable memory storage system for electronic musical instruments utilizing an erasable and reprogrammable read only memory (EPROM). This system is adaptable to any electronic musical instrument control circuit where user reprogrammable read only memory storage or decoding is desirable.

The use of memory devices in electronic musical instruments is known in the prior art. For example a rhythm pattern generator system is known where the memory device is used to activate a sequence of rhythm voices during the pattern generation. However, in a conventional system of this type, there is the limitation that the memory pattern is fixed and cannot be modified except by replacing the memory integrated circuit with another integrated circuit containing a different coding pattern. This is a relatively expensive procedure and is beyond the capability of the typical user of such a system to implement. Random access memories (RAM) on the other hand, although more readily adaptable to reprogramming by the user, are a volatile type of storage element and must be reprogrammed each time the power is turned off in the system. Other types of memory storage systems from the prior art such as paper tape, cards, magnetic tape or optical discs are not readily adaptable to low cost large-scale integrated circuit designs and require much additional peripheral equipment such as card punches and recorders to program. The present invention circumvents the shortcomings and limitations of these prior art systems and presents a novel and practical method of providing user programmable non-volatile storage in electronic musical instruments which is adaptable to low cost, large-scale integrated circuit design.

OBJECTS OF THE PRESENT INVENTION

The present invention lends itself to many potential applications in the electronic musical instrument art. Among these applications are rhythm pattern generators, arpeggio pattern generators, voicing circuits in digital type electronic musical instruments, attack and decay control circuits in digital type electronic musical instruments, chord pattern generators, chord sequence generators, stop tab voicing registration systems and player piano or organ systems.

It is an object of the present invention to provide a memory system for electronic musical instruments which is non-volatile is readily adaptable to user reprogramming and is adaptable to low cost integrated circuit design.

It is a further object of the invention to provide a memory system which is readily adaptable to a wide range of potential applications in any electronic musical instrument control circuit where user reprogrammable memory storage or decoding is desirable.

The foregoing as well as other objects and advantages of the present invention will be understood from a study of the following description when taken in connection with the accompanying drawings wherein.

BRIEF DESCRIPTION OF THE DRAWINGS

FIG. 1 is a block diagram showing an embodiment of one form of the invention;

FIG. 2 shows, also in block form, two erasing sources for the invention, an electronic source and an ultraviolet (UV) light source;

DETAILED DESCRIPTION

Figure 3:
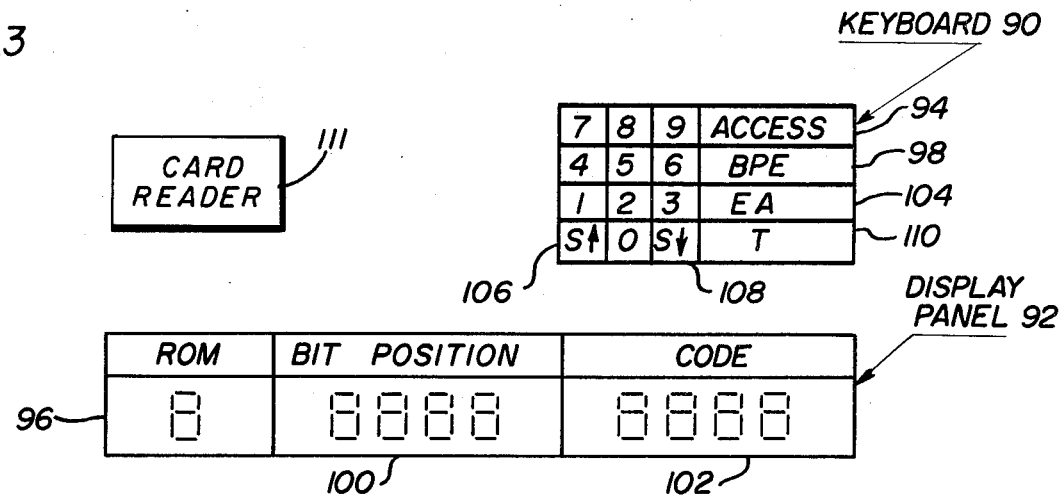
FIG. 3 shows a keyboard arrangement which may be used for input of data to the invention and a digital display panel for the readout of data.

Referring now to FIG. 1, a block diagram of the proposed system, the primary storage element is an erasable and reprogrammable read only memory (EPROM) 10. One example of a suitable device is the Intel 1702A. The Intel device is a 2,048 bit memory, but the proposed system, can use according to the present invention, any size EPROM or combinations of several EPROM'S. The read only memory is provided with an erasing source 12.

Read only memories in integrated circuit form are available with two types of erasing means. In the first type, such as an Intel silicon gate MOS 1702A, the device is erased by exposing a transparent lid on the top of the integrated circuit to a high intensity ultraviolet (UV) light at a wave length of 2537 A. In the second type such as a General Instrument part ER 2050, the device is electronically erasable by electronic erasing means connected therewith. Thus, FIG. 2 shows both the ultraviolet light source **12*a* and the electronic erasing source 12*b* being used in conjunction with each type of read only memory device, designated 10*a* and 10*b*, respectively. After erasure, all the bits of the read only memory are in the zero state. Information is then introduced by selectively programming ones into the proper bit locations. The read only memory is then provided with an input/output (I/O) buffer 14 connected bidirectionally thereto by connecting means 16, and an input address multiplexer (MUX) 18, connected thereto by connecting means 20. A temporary storage element (TSE) 22 which may be random access memory (RAM) is shown which is provided with input/output (I/O) buffer 24, bidirectionally connected by connecting means 26, an address control counter 28, connected thereto by connecting means 30 and a read write control (R/W) 32, connected thereto by connecting means 34. The TSE input/output buffer 24 is also bidirectionally connected with the EPROM input/output buffer 14 by connecting means 33, and the address control counter 28 is connected to the input address multiplexer 18 by connecting means 35**. The EPROM and the TSE then may communicate through the aforementioned devices and connecting means so that data may be transferred bidirectionally therebetween.

The EPROM also communicates with the electronic musical instrument with which the system is being used through the EPROM input/output buffer 14 and input address multiplexer 18 and connecting means 16 and 29 so that data may be fed from the instrument to the read only memory through connecting means 36 and the input address multiplexer 18, and the corresponding output may be fed back to the instrument through the EPROM input/output buffer 14 and connecting means 38. Also shown in the diagram is the user programming system which includes an input system 40 and a data entry control 44, with means 46 connecting with the input system 40. The data entry control is also connected with the read/write control 32 by connecting means 50, with the address control counter 28 by connecting means 52 and with the TSE input/output buffer 24 by bidirectional connecting means 54. Also provided is a binary code to decimal (BCD to DEC) decoder 56 connected to the data entry control 44 by connecting means 60, and readout means 58 connected to the decoder 56 by connecting means 62, so that, while system processing is performed all in binary code, the data entry from the input as well as the readout may be in conventional base 10 to simplify operator usage and minimize operator errors. Also provided is a data transfer control (DTC) 64 which is bidirectionally connected with the data entry control 44 by connecting means 66, connected to the EPROM input output buffer 14 by connecting means 68, connected to the erasing source 12 by connecting means 70, connected to the EPROM 10 by connecting means 72 and 74, connected to the input address multiplexer 18 and the address control counter 28 by connecting means 72 and 76, and connected to the read/write control 32 by connecting means 78. The data transfer control 64 directs and controls the bidirectional transfer of data between the input system 40 and the TSE 22 and EPROM 10 and between the EPROM 10 and the electronic musical instrument, through the aforementioned data entry control 44, read/write control 32, address control counter 28, input address multiplexer 18 and EPROM input/output buffer 14, and the aforementioned connecting means, and controls the erasing source 12 through connecting means 70.

Referring now to FIG. 3, one of the many possible data entry systems is shown as a calculator-type keyboard 90 and digital readout display panel 92 combination. In the general case where multiple read only memory chips may be used, the operator would first depress the Access button 94 on the keyboard followed by a digit button corresponding to the read only memory to be modified. This would disable the lines to and from the electronic musical instrument, then transfer contents of this read only memory (EPROM) to the temporary storage element TSE and activate the erasing source for the read only memory (EPROM), whether it be an ultraviolet light or electronic erasure source, to erase the contents of the EPROM. Once the data transfer has been completed and the erase mode has been initiated, the number of the read only memory EPROM being processed will appear on the readout in the ROM slot 96 to indicate that the system is ready to accept reprogramming. The contents of the read only memory (EPROM) are transferred to the temporary storage element (TSE) before the erase cycle is initiated to enable the operator to make minor modifications to the code without having to enter in every word all over again. For example, if the code at address 25 is the only bit to be changed in the read only memory, the operator would enter 25 on the keyboard and depress the bit position entry (BPE) button 98. This would display the address 25 in the bit position slot 100 in the readout and the existing code in that position would be displayed in the code slot 102 of the readout. To change this code, the operator would then enter the new value on the keyboard and depress the enter TSE (EA) control button 104. This new value would be entered into the temporary storage element (TSE) and displayed on the readout. If desired, the operator could then verify the remaining codes in the system by depressing the S ↑ 106 button to sequence the system one count up at a time or the S ↓ 108 button to sequence the system one count down at a time thereby displaying the code at each bit position remaining in the TSE.

When the new code sequence has been completed and check to the satisfaction of the operator, the transfer button (T) 110 is depressed to transfer the contents of the temporary storage element (TSE) back into the read only memory (EPROM). Since the EPROM requires multiple data entries for proper programming, the TSE would then be cycled through its entire pattern fifty times before returning the EPROM to the control of the electronic musical instrument circuitry.

If the entire code in the EPROM is to be modified, the operator would then start from bit position number 1 and sequence through the entire program using the S ↑ button 106, then verify the new codes being entered by using the S ↓ button 108. The total number of codes and readout positions available is of course dependent on the total bit capacity of the particular read only memory (EPROM) circuit used.

Figure 4:
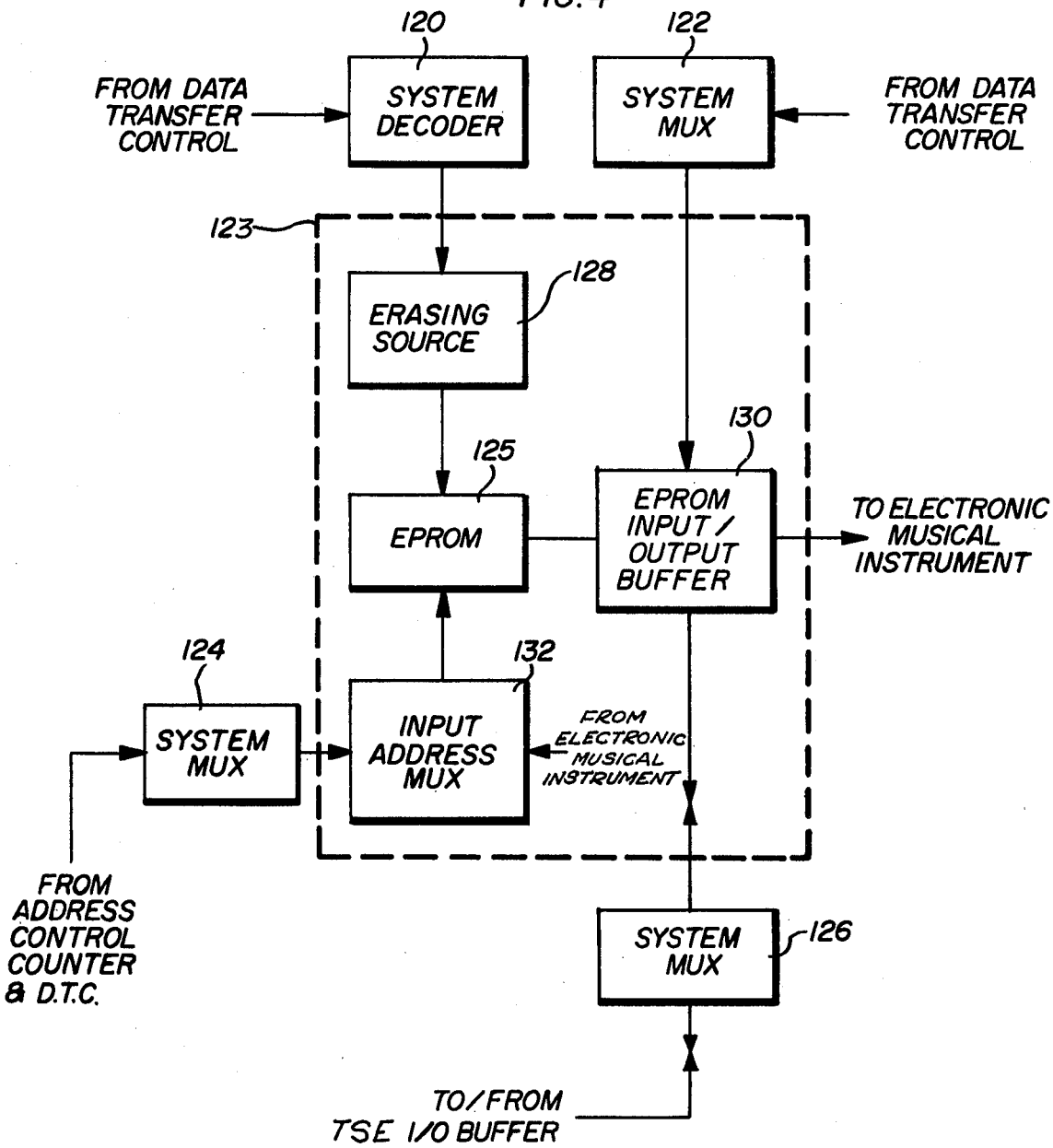
FIG. 4 shows several system multiplexers connected to a representative member of a multiple EPROM system.

In an application of this system where complex chords or patterns are to be used frequently or where it is desirable to have a number of preprogrammed voices, attack/decay patterns or stop-tab voicing registrations, the input system 40 could be in the form of a card reader 111 rather than a keyboard, as shown in FIG. 3, in which the cards would be preprogrammed with the desired information. Different configurations are also possible under the present invention for handling multiple memory requirements in a system of this type. First, one large temporary storage element (TSE) and read only memory (EPROM) could be utilized for overall system control. In this case, sections of the EPROM would be assigned specific access codes for the different functions to be performed. However, the transfer of data in this case would always include the entire EPROM content. In another configuration, multiple read only memories (EPROMS) would be utilized in conjunction with a single temporary storage element (TSE) whose capacity is equal to that of the largest EPROM in the system. In this case, separate erasure means would be provided for each EPROM. The multiple EPROM input and output lines would then be multiplexed into the system using a system decoder 120 system multiplexers 122, 124 and 126 as shown in FIG. 4. FIG. 4 shows a single member of a multiple member EPROM system. Such a system includes a plurality of members 123 such as that shown, the remainder of the system being as shown in FIG. 1. Each member 123 includes an EPROM 125, and erasing source 128, an input/output buffer 130 and an input address multiplexer 132, all with the same interconnections and functions as described for the elements of the same names in FIG. 1. Also shown are parts added to the system of FIG. 1 to facilitate its use with the multiple EPROM system, and their interconnectors with the representative member 123. These are: a system decoder 120 to control the erasing source which is controlled by the data transfer control 64, of FIG. 1; system multiplexer 122 connected to the EPROM input/output buffer 130, controlled by the data transfer control 64, of FIG. 1, system multiplexer 124, from the address control counter 28 of FIG. 1 to the input address MUX 132 and system multiplexer 126 bidirectionally connected between the TSE input/output buffer 24, of FIG. 1, and the EPROM input/output buffer 130.

The following, in outline form, is a typical sequence of operation of the system according to the present invention.

Sequence of Operation (Reference: FIG. 1)

(1) EPROM Processing Code Data in Organ Circuit
  (a) Code Address fed to EPROM through Input Address Multiplexer (MUX)
  (b) Corresponding coded output fed back to organ circuit through input/output buffer.
(2) Reprogram EPROM
  (1) Depress "ACCESS" key and digit 1 key (if EPROM #1) is to be accessed.
  (2) Data Entry Control circuit processes key depression and activates the data transfer control circuit.
  (3) Control lines accepting and returning data to organ circuits are disabled in MUX and decoder networks.
  (4) Data transfer control circuit activates write mode of TSE, read mode of EPROM and sequences the address control counter through all memory positions.
  (5) After the memory contents of the EPROM have been transferred into the TSE, the data transfer circuit will deactivate the address control counter, activate the erasing source and enable the transfer of the "R1" code to the readout panel.
  (6) System is now ready to accept reprogramming.
  (7) Depress Digit 1 button followed by BPE button.
  (8) TSE is placed in Read mode by R/W control.
  (9) Address counter initialized at Count 1 position.
  (10)
    (a) Digit "1" code is fed to readouts for display in Bit Positions Slot.
    (b) TSE output code is fed to readouts through data entry control circuit.
  (11) Enter in new code
    (a) Depress proper digit buttons.
    (b) Depress Enter TSE (EA) button.
  (12) TSE is placed in write mode by R/W control activated by data transfer control circuit.
  (13) New code is fed through I/O buffer to TSE and entered.
  (14) TSE is returned to read mode and new code is displayed on readouts.
  (15) Depress S ↑ button.
    (a) Address control counter is advanced one step by data entry control circuit.
    (b) Steps 6–14 are then repeated until entry of desired code modification is completed.
  (16) New coding pattern complete.
  (17) Verify code before transfer.
    (a) Sequence through code pattern by depressing S ↓ button and observing code displayed on readout panel.
  (18) Verification complete — Transfer data to EPROM
  (a) Depress transfer button (T).
    (b) Data Entry control circuit deactivates readouts and erasing source (through data transfer control circuit).
    (c) TSE is placed in read mode by R/W control.
    (d) EPROM is placed in "program" mode by data transfer circuit.
    (e) Address control counter sequences through all bit positions 50 times under control of data transfer circuit.
    (f) Data from TSE is transferred through TSE I/O buffer to EPROM I/O buffer and entered into EPROM (under control of data transfer circuit).
  (19) Transfer Complete
    (a) Data transfer circuit returns system to Step 1 state.

Figure 5:
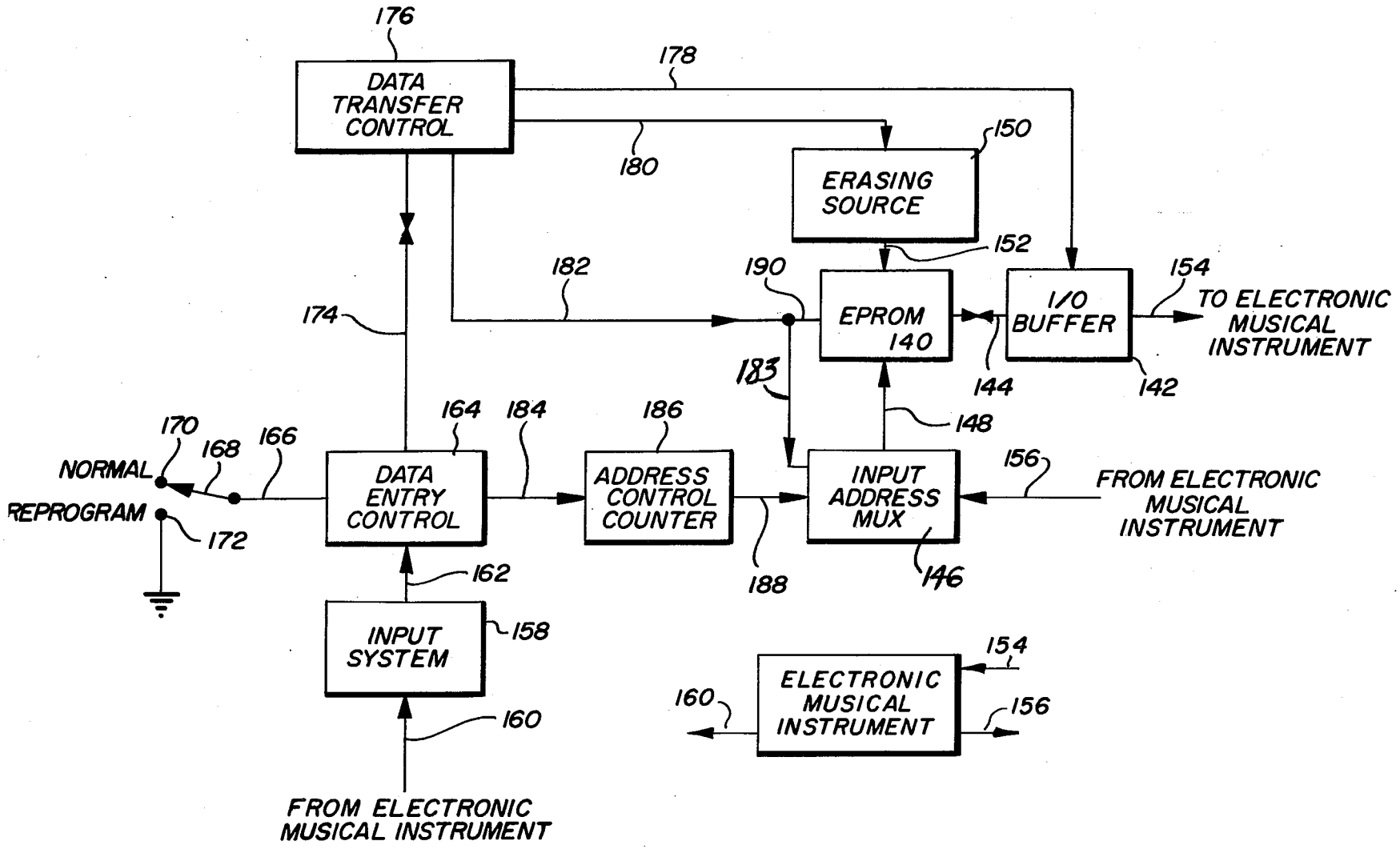
FIG. 5 shows in block diagram form, an embodiment of another form of the invention.

Referring now to FIG. 5, a block diagram illustrates another embodiment of an apparatus incorporating features of the present invention. While the embodiment described above in the references to FIG. 1, FIG. 2 and FIG. 3 details an apparatus according to the present invention which includes a variety of features, the embodiment of FIG. 5 comprises a simpler more basic EPROM system in accordance with the present invention. This simpler embodiment does not utilize the temporary stroage device, the readouts and the peripheral devices associated therewith of the previous embodiment. In this form, the apparatus can be used in conjunction with an electronic musical instrument as a stop tab registration preset system, a chord or note sequence generator system, or any type of programmable system in which the apparatus could cooperate with an electronic musical instrument using the switching controls of the instrument for user input.

Referring now specifically to FIG. 5, the embodiment illustrated therein includes an erasable and programmable read only memory (EPROM) 140 which is provided with an input/output (I/O) buffer 142, bidirectionally connected with the EPROM by connecting means 144, an erasing source 150 connected with the EPROM by connecting means 152, and an input address multiplexer (MUX) 146 connected with the EPROM by connecting means 148. Also included is an input system 158 for receiving information from the electronic musical instrument connected thereto by connecting means 160, the input system 158 being connected to a data entry control 164 by connecting means 162. The data entry control 164 is provided with a switch 168 connected thereto by connecting means 166, the switch 168 having a normal position 170 and a reprogram position 172. The data entry control 164 is also provided with an address control counter 186 connected thereto by connecting means 184, the address control counter also being connected to the input address multiplexer 146 by connecting means 188. Further included is a data transfer control 176, which performs overall system control functions. The data transfer control 176 is connected to the data entry control 164 by bi-directional connecting means 174, to the input/output buffer 142 by connecting means 178, to the erasing source 150 by connecting means 180, to the EPROM 140 by connecting means 182 and 190, and to the input address multiplexer 146 by connecting means 182 and 183. Among other functions of the data transfer control 176 are controlling the transfer of data from the EPROM 140 through the input output buffer 142 to the electronic musical instrument which is connected to the input/output buffer 142 by connecting means 154, and controlling the transfer of data from the electronic musical instrument to the EPROM 140 through the input address multiplexer 146 which is connected to the electronic musical instrument by connecting means 156.

As a specific example, to which no limitation is intended, the functions of this embodiment are described below with reference to its use in a stop tab registration preset system. With the programming switch 168 in its normal 170 position, the number of the preset combination selected on the electronic musical instrument circuitry is fed to the already programmed EPROM 140 through connecting means 156, the input address multiplexer 146, and connecting means 148. The stop tab activation data called for by the preset combination number thus fed into the EPROM would then be fed back to the electronic musical instrument control circuits through connecting means 144, the input/output buffer 142, and connecting means 154. Since the programming switch 168 is in the normal position 170, the data entry control 164 causes the data transfer control 176, through connecting means 174, to allow the aforesaid transfers of data through the input/output buffer 142 and the input address multiplexer 146 which it controls through connecting means 178 and 182, respectively.

When the programming switch 168 is in the reprogram position 172, the data entry control 164 feeds the appropriate signal to data transfer control 176, so that the data transfer control causes the system to function as follows. The data transfer control allows stop tab and preset number data to be fed from the electronic musical instrument control circuitry through connecting means 160 to the input system 158 and thence to the data entry control 164 through connecting means 162. The data transfer control then activates the erasing source 150 through connecting means 180, and activates the input address multiplexer 146 through connecting means 182. This allows the data to be transferred from the data entry control 164 to the address control counter 186 through connecting means 184, and from the address control counter 186 (which is in sync with the data coming from the electronic musical instrument) to the EPROM 140 through connecting means 188, the input address multiplexer 146 and connecting means 148. The input/output buffer 142 then is activated by data transfer control 176 through connecting means 178, to become an input buffer and allow the appropriate codes to be entered into the EPROM 140 from the electronic musical instrument through connecting means 154, the input/output buffer 142, and connecting means 144. The data transfer control 176 would then allow a suitable number of complete data scans to reprogram the particular EPROM being used to insure that all the data is entered before terminating the reprogramming process.

The embodiment of FIG. 5 may, according to the present invention, also be adapted to be used with a multiple EPROM system as detailed above in the reference to FIG. 4. In this multiple EPROM system, the additional components and interconnections are the same as those illustrated in FIG. 4 and described above in the references thereto. However, system multiplexer 126, connected between the TSE I/O buffer and the EPROM I/O buffer is deleted in this embodiment, as there is no temporary storage element in this embodiment.

The specific embodiments of the invention as herein shown and described are for illustrative purposes. Various changes will no doubt occur to those skilled in the art and will be understood as forming a part of the present invention insofar as they fall within the spirit and scope of the appended claims.

The invention is claimed as follows:

1. A programmable memory system for an electronic musical instrument comprising: a programmable and erasable read only memory, erasing means for selectively erasing said memory, a first input/output buffer and an input address multiplexer, respectively connected between said memory and said instrument for bidirectionally transferring data therebetween, a temporary storage element, a read/write control, a second input/output buffer and an address control counter connected respectively with said temporary storage element, said address control counter being connected with said input address multiplexer and said first input/output buffer being connected with said second input/output buffer for bidirectionally transferring data between said read only memory and said temporary storage element, and means for entering and retrieving data including an input system, a binary to decimal decoder, a data entry control connected between said input system and said decoder, readout means connected with said decoder, and a data transfer control, said data entry control being connected with said data transfer control, with said read/write control, with said address control counter and with said second input/output buffer and said data transfer control being connected with said read/write control, with said erasing means, with said first input/output buffer, with said read only memory, with said address control counter and with said input address multiplexer, for bidirectionally transferring data between said entering and retrieving means and both said read only memory and said temporary storage element, for displaying data on said readout means and for selectively activating said erasing means.

2. The system of claim 1 wherein said read only memory comprises an ultraviolet light erasable ROM, said erasing means comprises an ultraviolet light source, and further including means for selectively exposing said read only memory to said ultraviolet light source.

3. The system of claim 1 wherein said read only memory comprises an electronically erasable ROM, said erasing means comprises electronic erasing means, and further including means for connecting said electronic erasing means to said memory.

4. The system of claim 1 wherein said input system comprises a calculator type keyboard and said readout means comprises a digital display panel.

5. The system of claim 1 wherein said input system comprises a card reader.

6. The system of claim 4 wherein said calculator keyboard is provided with means for sequencing the temporary storage element through its bit positions, one count up or one count down at a time.

7. A programmable memory system for an electronic musical instrument comprising: a plurality of programmable and erasable read only memories, erasing means for selectively erasing said read only memories, a plurality of input/output buffers and input address multiplexers each connected with respective ones of said read only memories, a temporary storage element, a read write control, an input/output buffer and an address control counter respectively connected with said temporary storage element, a first system multiplexer connected between said temporary storage element input/output buffer and said plurality of read out memories input/output buffers, a second system multiplexer connected between said address control counter and said plurality of input address multiplexers, for bidirectionally transferring data between each of said read only memories and said temporary storage element and between each of said read only memories and said electronic musical instruments, and means for entering and retrieving data including an input system, a binary to decimal decoder, a data entry control connected between said input system and said decoder, readout means connected with said decoder, and a data transfer control connected with said data entry control, a third system multiplexer connected between said data transfer control and said plurality of read only memories input/output buffers, a system decoder connected between said data transfer control and said erasing means, and means connecting said data transfer control to said second system multiplexer, for bidirectionally transferring data between said entering and retrieving means and both said plurality of read only memories and said temporary storage element, for displaying data on said readout means and for selectively activating said erasing means.

8. The system of claim 7 wherein said read only memories comprise ultraviolet light erasable ROM's, said erasing means comprise ultraviolet light source, and further including means for selectively exposing said ROM's to said ultraviolet light sources.

9. The system of clam 7 wherein said read only memories comprise electronically erasable ROM's, said erasing means comprise electronic erasing means, and further including means interconnecting said electronic erasing means and said ROM's.

10. The system of claim 7 wherein said input system comprises a calculator type keyboard and said readout means comprises a digital display panel.

11. The system of claim 7 wherein said input system comprises a card reader.

12. The system of claim 10 wherein said calculator keyboard is provided with means for sequencing the temporary storage element through its bit positions, one count up or one count down at a time.

13. A programmable memory system for an electronic musical instrument comprising: programmable and erasable memory means erasing means for selectively erasing said memory means, input-output buffer means and input address multiplexer means respectively connected with said memory means, a data entry control including means for selectively switching between a normal mode and a reprogram mode, an address control counter connected between said data entry control and said input address multiplexer means, an input system connected between said data entry control and said electronic musical instrument, and a data transfer control provided with connections to said data entry control, to said input-output buffer, to said erasing source, to said memory means and to said input address multiplexer, said data transfer control being adapted when said data entry control is in said normal mode, to cause said input-output buffer to transfer data from said memory means to said electronic musical instrument, and to cause said input address multiplexer to transfer data from said electronic musical instrument to said memory means, said data transfer control being further adapted when said data entry control is in said reprogram mode, to activate said erasing source for erasing said memory means, to cause said data entry control and said input address multiplexer to allow the transfer of data from said electronic musical instrument to said memory means through said input system, said data entry control, said address control counter and said input address multiplexer, and to cause said input-output buffer to transfer data from said electronic musical instrument to said memory means.

14. The system of claim 13 wherein said memory means comprises a programmable and erasable read only memory.

15. The system of claim 13 wherein said memory means comprises a plurality of programmable and erasable read only memories, said input address multiplexer and said input/output buffer means comprise a plurality of respective input address multiplexers and input/output buffers each being connected with respective ones of said plurality of memories, and further including a first system multiplexer connected between said address control counter and each of said input address multiplexers, a second system multiplexer connected between said data transfer control and each of said input/output buffers and a system decoder connected between said data transfer control and said erasing means.

* * * * *

UNITED STATES PATENT OFFICE

CERTIFICATE OF CORRECTION

Patent No. 4,078,465 Dated March 14, 1978

Inventor(s) Robert W. Wheelwright

It is certified that error appears in the above-identified patent and that said Letters Patent are hereby corrected as shown below:

Column 2, line 60, "29" should be --20--;

Column 4, line 6, "check" should be --checked--;

Column 6, line 16, "stroage" should be --storage--;

Column 8, line 58, "read out" should be --read only--;

Column 9, line 16, "source" should be --sources--;

Column 9, line 19, "clam" should be --claim--;

Column 9, line 29, after"calculator" insert --type--

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*